United States Patent [19]

Pitroda

[11] 4,432,105

[45] Feb. 21, 1984

[54] SHOWER DEVICE

[76] Inventor: Pravin G. Pitroda, 401 Fairlane Dr., Joliet, Ill. 60435

[21] Appl. No.: 322,467

[22] Filed: Nov. 18, 1981

[51] Int. Cl.[3] ..... A47K 3/22

[52] U.S. Cl. ..... 4/597; 4/605; 4/615; 137/893; 222/144.5; 239/303; 239/318

[58] Field of Search ..... 4/597, 596, 605, 615; 239/70, 303, 304, 305, 318, 310, 317; 137/624.11, 889, 268, 893; 222/148, 630, 144.5; 366/280

[56] References Cited

U.S. PATENT DOCUMENTS

| | | | |
|---|---|---|---|
| 1,841,414 | 1/1932 | McBride | 366/280 X |
| 2,068,757 | 1/1937 | Mishelle | 4/606 |
| 3,106,345 | 10/1963 | Wukowitz | 239/318 |
| 3,231,200 | 1/1966 | Heald | 239/318 |
| 3,486,695 | 12/1969 | Novak | 137/624.11 X |
| 3,720,352 | 3/1973 | Kozlowski | 239/305 X |
| 3,917,172 | 11/1975 | O'Hare | 239/305 |
| 4,121,773 | 10/1978 | Headen et al. | 239/318 X |
| 4,200,206 | 4/1980 | Chase et al. | 137/889 X |
| 4,218,013 | 8/1980 | Davison | 239/318 X |
| 4,358,056 | 11/1982 | Greenhut et al. | 239/305 |

FOREIGN PATENT DOCUMENTS

| | | | |
|---|---|---|---|
| 173953 | 12/1958 | Austria | 366/280 |

*Primary Examiner*—Henry K. Artis
*Attorney, Agent, or Firm*—Dick and Harris

[57] ABSTRACT

A plumbing device stores one or more additives, and allows injection and mixing of such additives into the water stream delivered to a plumbing fixture such as a shower head or faucet. The design of the passage for the water stream provides a pressure differential sufficient to draw the additive into the water stream, while check valves are used to prevent backflow of additives. A mixing chamber, with an impeller element, mixes the injected material with the water stream. Metering valves may be used to control the amount of additive dispensed.

8 Claims, 4 Drawing Figures

FIG. 1
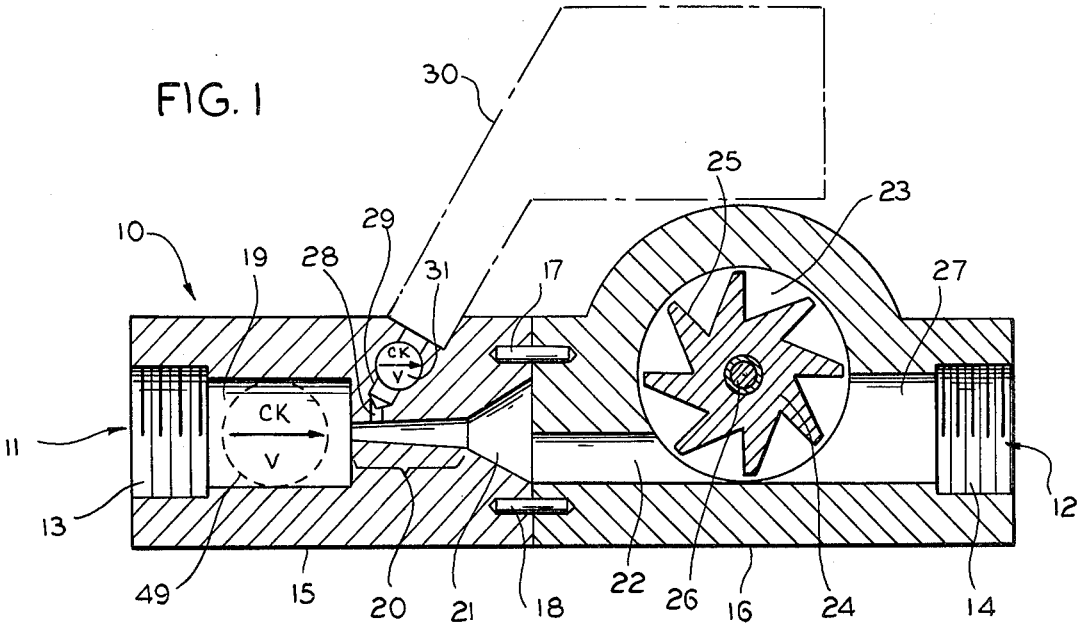
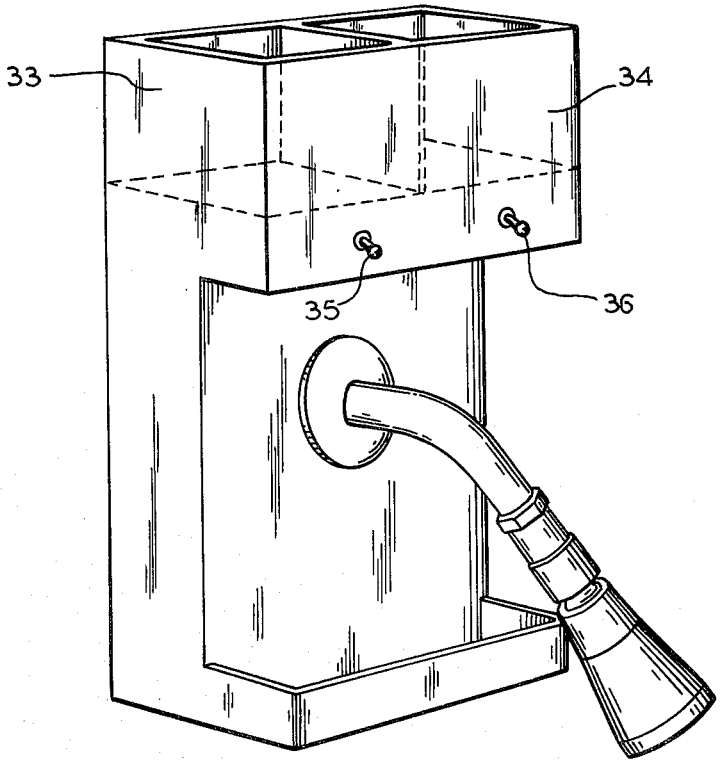
FIG. 2

SHOWER DEVICE

My invention relates generally to the area of plumbing fixtures and, more particularly, to a mixing device which enables the selective combination of bath oils, shampoo, soaps, and the like with the stream of water coming from a fixture such as a shower head or faucet. My invention may be provided in a form which is attachable to a conventional and already installed shower arrangement, or faucet, or may be provided in a configuration intended for installation as original equipment.

There have been efforts by others to provide a shower accessory which would enable the shower user to select a bathing additive, such as bath oil or shampoo, to be mixed with the stream of water coming from the shower head. However, to my knowledge, these devices have not become popular or commercially successful.

One such device is described in U.S. Pat. No. 3,486,695 issued to Novak. Another such is U.S. Pat. No. 4,027,822 issued to Usher. Yet another is U.S. Pat. No. 4,200,206 issued to Chase et al.

The problems encountered by prior art devices such as those referred to above center around the fact that the additives selected to be injected into the water stream are often times viscous or partially insoluble. This can lead to the clogging of the relatively small exit holes formed in a shower head, necessitating frequent cleaning of the shower head, making the unit inconvenient to use, and discouraging people from utilizing it. Another disadvantage of prior efforts in this area is the failure of such units to provide simple, positive-acting structure enabling several types of bath additives to be simultaneously stored in the unit and selectively used. For example, within a single family, there may be several favorite brands of shampoo or soap among the family members, or bath oils or other additives which would be appropriate for use by some members of the family may be totally inappropriate for other members of the family. To this end, such a unit should provide for the storage of multiple bath additives and should employ a simple and direct method to inject whatever additive is selected by the user.

Another disadvantage of prior efforts in this area is the difficulty with which such units are retro-fitted to existing plumbing installations, and the bulk and nonattractiveness of the units after they are installed.

Accordingly, the present invention has the following objects:

To provide a device making it possible to inject bath oils or other additives into the water stream from a plumbing fixture, such as a shower or faucet quickly and effectively;

To provide such a device with means to mix the additive with the water stream prior to its exit from the fixture;

To provide such a device in versions which allow the storage therein and use of multiple bath oils, soaps or additives;

To provide such units in forms which are economical to manufacture, attractive in appearance, and which are easy and simple to install on existing facilities;

To provide such devices with positive-acting means to select individual additives; and To provide such devices in forms which are compact and attractive for installation as original equipment.

These, and further objects, will become more apparent upon a consideration of the accompanying drawings wherein:

FIG. 1 is a side sectional view of one version of my invention;

FIG. 2 is a perspective view of a contemplated version of my invention;

Figure 3:
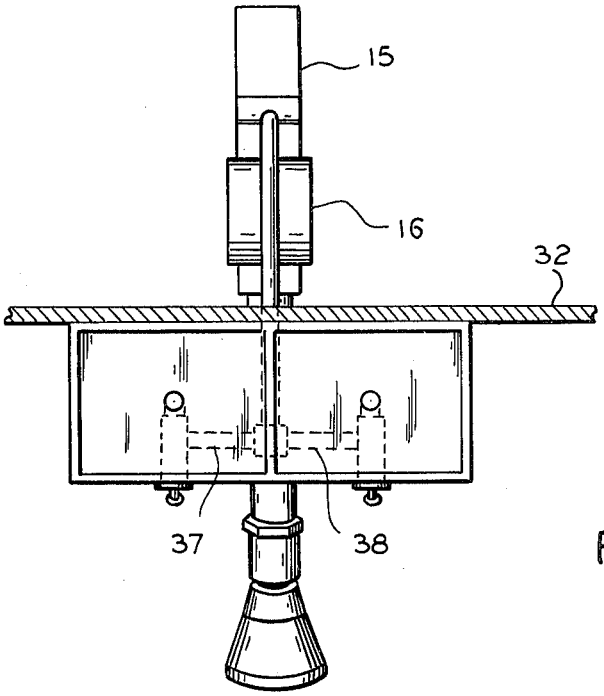
FIG. 3 is a top view of the embodiment shown in FIG. 2.

There is described herein, in varying scope, an accessory making possible the injection of additives to the stream of water exiting from a plumbing fixture.

To this end, the present invention has an inlet, intended to be attached to the pipe which feeds water to the fixture. In one embodiment of the invention, such attachment may be made as an original piece of equipment, installed when the pipe itself is installed. In another embodiment, the inlet is attachable to that portion of the pipe that has been threaded to receive the original fixture.

Water reaches an entry chamber by way of the inlet. At its outlet end, the entry chamber is restricted to form a throat, the initial diameter of which is substantially smaller than that of the entry chamber. The throat diameter gradually increases in the direction of flow until it reaches a frusto-conical chamber, where exit diameter is substantially larger than its entry diameter. The frusto-conical chamber serves as a pooling chamber for preliminary or initial mixing of water and additive with siphoning off of the mixture taking place through the mixing entry to the main mixing chamber.

The geometry of the throat and exit chamber is such that the water stream passing therethrough increases its velocity with a corresponding drop in pressure, with respect to the velocity and pressure of the water supply as it entered the inlet.

An additive inlet communicates with the throat and includes apparatus to enable a selected additive to be directed to the inlet, to be thereby drawn into the throat by the pressure differenital created when water flows through the throat. The precise manner in which this directing is accomplished will be discussed in detail hereinbelow.

After the additive has entered the water stream, the stream is directed to a main mixing chamber via a mixing chamber entry. In a preferred embodiment of the present invention, the mixing chamber is constructed as a cylinder with its axis arranged perpendicular to the water flow path. Mounted coaxically and rotably within the mixing chamber is a mixing wheel having a plurality of vanes shaped and positioned to have the incoming water/additive stream impinge thereon, thus imparting rotational movement to the mixing wheel.

The main mixing chamber terminates at an outlet which may be constructed to receive a standard fixture, and the mixed stream of additive and water is thereafter directed for use during one's laving.

A plurality of separately-formed reservoirs are provided as a preferred means of storing bath additives until use thereof is desired. Each such reservoir has a drain leading therefrom, selectively opened and closed by a toggle-type valve. The drains communicate with a master drain which, in turn, leads to the additive inlet formed at the previously-described throat. In the fashion, it is contemplated that a mixture of additives may, if desired, be employed.

It is also contemplated that means, such as spring-biased valve assemblies, be used to allow the injection of a pre-measured amount of additive. The valve, when actuated, would close automatically, interrupting the flow of additive.

Referring now to FIG. 1, the numeral 10 indicates generally an embodiments drawn to a shower accessory intended to enable the injection of a bath additive such as that described above, and the mixing thereof downstream of the injection point and upstream of the shower head or exit point.

Accessory 10 has an inlet 11 and an outlet 12, with both inlet and outlet threaded, as at 13 and 14, to accommodate the sizes and pitch of thread most commonly associated with conventional shower head fittings. Accessory 10, in one embodiment, is formed of two housing segments, a rear or injection segment 15, and a forward or mixing segment 16. Segments 15 and 16 may be fastened together, such as through use of pins or fasteners shown schematically at 17 and 18.

Injection segment 15 has entry chamber 19 formed therein, communicating with inlet 11, within this embodiment, a diameter approximating that of the shower piping to which inlet 11 is intended to be attached. Downstream of chamber 19, the liquid flow path is constricted, at throat 20, which, in this embodiment, consists of a passage intially narrow in diameter and gradually broadening in diameter. Thereafter, exit chamber 21 communicates with throat 20 and, as herein shown, expands from an initial, smaller diameter to a final, larger diameter, substantially larger than, correspondingly, the inlet and outlet diameters of throat 20. In the present embodiment exit chamber 21 serves as a pooling area for preliminary mixing of the water and additive components. The aforementioned mixture is then siphoned off to the main mixing segment 16 by mixing entry 22.

Mixing segment 16 communicates with injection segment 15 at the outlet to exit chamber 21, wherein the liquid passing through exit chamber 21 is directed into mixing entry 22. Entry 22 may be sized to overlap only a portion of the outlet of exit chamber 21, thus creating turbulence for initial mixing. In the embodiment herein shown, a transverse cylindrical cavity 23 is formed with its axis perpendicular to the axis of mixing entry 22. Rotatably positioned within transverse cylindrical cavity 23 is main mixing element 24 which, in this embodiment, consists of a paddlewheel having individually formed vanes 25 formed peripherally thereabout and rotatably mounted on axle 26. In this embodiment, vanes 25 are sized and dimensioned such that said vanes are at least as large as the diameter of mixing entry 22.

Downstream of mixing element 24 is mixing segment exit 27 which communicates directly with outlet 12.

When installed, it is contemplated that the inlet 11 will be attached to the shower supply pipe while outlet 12 will be attached to whatever shower head is selected by the user.

Injection of a selected bath additive is accomplished in the following manner. An additive inlet 28 is formed along throat 20 communicating with an additive supply segment 29. This segment 29, in turn, communicates with a reservoir 30, shown in FIG. 1 in schematic form, and it is contemplated that said reservoir may either be an integral part of one such assembly 10, or may represent a vessel positioned apart from the unit and connected to the unit by tubing or other suitable means.

As shown in FIG. 1, a check valve 31 is positioned between additive unit 28 and reservoir 30. The purpose of such a check valve is to insure that a flow path exits from reservoir 30 into throat 20, while preventing any backflow through additive inlet 28 up into reservoir 30. As will be discussed hereinbelow, said check valve may, if required, be positioned elsewhere in the unit, but its function will remain the same, that is, to assure a one-way flow path from a selected reservoir into the unit.

In the present embodiment, mixing element 24 is powered by and motivated by the force of the liquid stream passing through mixing entry 22 and impinging upon vanes 25. If desired or required, means may be provided to power mixing element 24 by external means such as a motor.

Check valve 31 is defeated by the drop in pressure created when the liquid stream enters throat 20 and travels along the constricted and gradually increasing taper of throat 20 and exit chamber 21. In this manner, for a given water flow rate, a predicatable amount of bath additive should be injectable into the liquid stream when desired, and the flow of such additive is not dependent upon gravity feed, or the establishment of a "head" requiring the placement of the reservoir a significant distance above inlet 28.

Referring now to FIG. 2, a second embodiment of my invention is herein shown, wherein the unit has been manufactured for installation as an original piece of equipment. As seen in FIG. 3, injection segment 15 and mixing segment 16 may thus be positioned behind shower wall 32 and may thus be concealed from sight.

Also shown in FIG. 2 is a preferred arrangement of reservoirs for the storage and eventual delivery of bath additives. In the embodiment shown in FIG. 2, additive reservoirs 33 and 34 are shown, however, it is contemplated that any selectable number of such reservoirs may be fashioned in order to provide storage capacity for numerous different types of bath additives.

In one embodiment, delivery of bath additive to injection segment 15 is controlled by toggle valves 35 and 36. With one such valve in the *on* position, bath additive will drain from the corresponding storage reservoir and will travel, via delivery conduits such as those shown at 37 and 38 in FIG. 3 to communicate with injection entry 28. Such switches are positive in operation, simple to actuate even with wet or slippery hands, attractive and easy to maintain.

Figure 4:
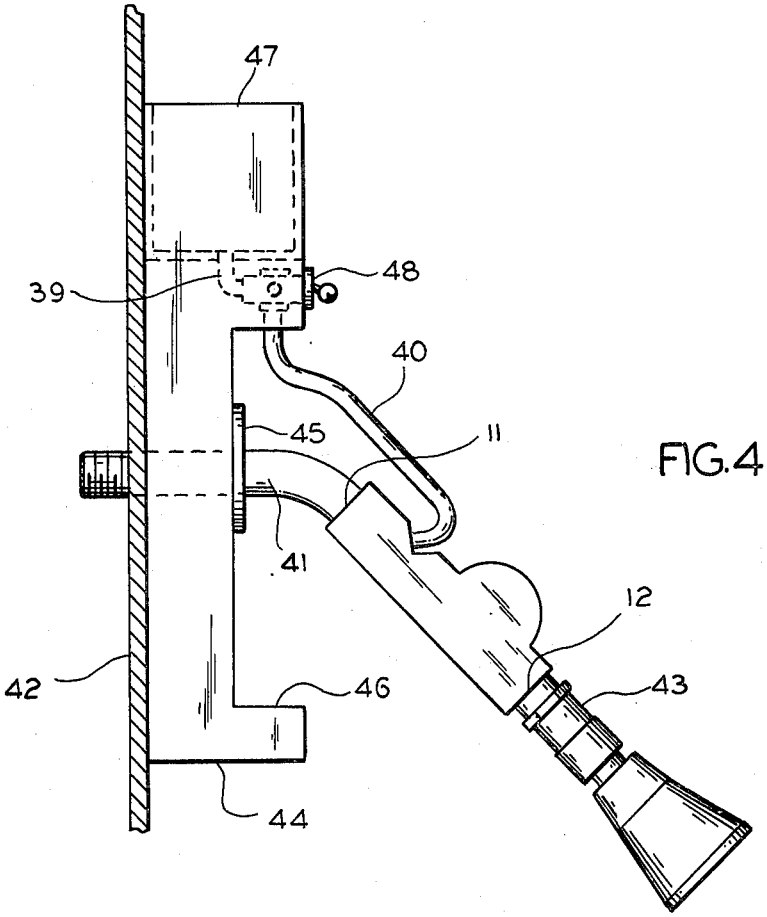
FIG. 4 is a side view of yet another embodiment of my invention intended for installation on already shower facilities.

As seen in FIG. 3, each such switch assembly 35 and 36 may also include, within the body thereof, a check valve assembly not herein specifically shown. Thus positioned, and as shown in FIG. 4, the check valve assembly will be positioned between reservoir drain 39 and supply conduit 40. It is also contemplated that the shapes of reservoirs 33 and 34 while herein shown as rectangular, may employ any shape either asthetically or mechanically pleasing or advantageous to the operation and appearance of the unit. It is also contemplated that a cover, although not herein specifically shown, may be employed to seal off the reservoirs to prevent water from being splashed therein, while at the same time maintaining a sufficient vent arrangement to enable the effective draining of the reservoir when the appropriate control switch is actuated.

In another preferred embodiment, a check valve may be positioned at inlet 11 to prevent possible migration of a water/additive mixture into the water supply lines of the house. As seen in phantom at 49 in FIG. 1, such a valve would prevent any backflow of undrained water through the unit when not in use.

A preferred embodiment would also provide toggle valves such as 35 and 36 with a spring-biased element which would keep said valves closed unless depressed and held. This would ensure that accidental draining of an entire reservoir would not occur, and would also provide a way to inject measured amounts of additive by depressing and then releasing the toggle. The length of time the valve would remain open would determine the amount of additive injected, and repeated depressions of the valve would result in more additive being dispensed.

In FIG. 4, there is shown an embodiment of my invention which is intended for installation on already existing shower facilities. Quite simply, the existing shower facility will typically have a curved segment of pipe 41 protruding past wall 42 onto which a conventional shower head 43 is typically attached. In order to employ the present invention, the shower head 43 is removed from pipe segment 41, an operation typically requires no more than the turning of shower head 43 by hand until it is unthreaded from such segments. Inlet 11 of accessory 10 is then threaded to shower pipe segment 41 until it is liquid tightly seated. Again, an operation which, it is contemplated, may be carried out by hand without the use of tools. Shower head 43 may, thereafter, be threaded to outlet 12 which, it is contemplated, makes up any required adaptors for use with shower heads of different thread pitches or configurations.

In the embodiment herein shown, housing 44 may be positioned about shower pipe 41 and collar 45, or other suitable means, may be used to secure housing 44. Housing 44 may also be attached directly wall 42 through use of conventional fasteners.

Housing 44 may include a segment 46 usable as a towel rack or otherwise usable to hang bath accessories such as brushes or the like. In the embodiment shown, a series of reservoirs, such as that indicated generally at 47 may be formed in housing 44, with each such reservoir being controlled by a separate toggle valve assembly 48 communicating to a common conduit, not herein specifically shown, which, in turn, is connected to drain 40. In this fashion, should the user desire a mixture of several bath additives, the appropriate toggle valve assembly switches may be flipped to the open position and the resulting additives will run together down drain 40 into injection segment 15 and, ultimately, into mixing segment 16 where said additives will be mixed together prior to exiting through shower head assembly 43.

While the use of toggle-type valves has herein been specifically described, it is contemplated that other valve assemblies may prove equally adequate, and the valve assemblies ultimately selected may represent asthetic as well as mechanical considerations on the part of the manufacturer and/or purchaser.

In the embodiment depicted in FIG. 4, it is contemplated that the individual injection segment 15 and mixing segment 16 of device 10 may be easily removed and disassembled for the purpose of repair, cleaning, or for the purpose of transporting the unit from one shower to another.

While the foregoing has presented specific embodiments of the invention herein described, it is to be understood that these embodiments have been presented by way of example, and are not intended to limit the spirit or scope of the application. One such additional embodiment contemplates the installation of the present invention to feed such additives to fixtures such as water faucets, for the purpose of supplying soaps and the like to persons washing their hands. Others may involve the mixing of secondary liquid streams with a primary stream. It is expected that others, skilled in the art will perceive variations from the foregoing which, while differing, remain within the spirit and scope of the invention as herein described and claimed.

I claim:

1. A shower device apparatus for combining a first liquid stream with selected secondary liquids into a mixed liquid outflow comprising:

an inlet for said first liquid stream at its first end;

an outlet for said outflow at its second end;

fluid conduit means for the passage of said liquid stream therethrough communicating with said inlet at its upstream end and with said outlet at its downstream end;

injection means interposed between said inlet and said outlet to inject selected ones of said secondary liquids into said first liquid stream within said fluid conduit;

said injection means having venturi means along a portion of its length so as to result in said secondary liquids being drawn into said fluid conduit; and main mixing means positioned intermediate said injection means and said outlet in a postion, substantially within said fluid conduit and cooperating with said venturi means to deliver said outflow in mixed fashion;

said main mixing means including rotatable impeller means positioned proximate said outlet for contact with and mixing of said first and second liquids into said liquid stream.

2. The apparatus as recited in claim 1 wherein said venturi means comprises:

a throat having an entrance and exit and shaped to linearly increase in cross-sectional area from said entrance to said exit so as to result in a drop in pressure of said liquid stream flowing therethrough;

a frustoconical section communicating with said exit of said throat, increasing in cross-sectional area therefrom, in the direction of fluid flow and reducing the pressure of said liquid stream flowing therethrough prior to the entry of said stream into the main mixing means communicating therewith;

gravity assisted secondary liquid dispensing means communicating with said venturi means to facilitate the drawing of said secondary liquid into said first liquid flowing within said fluid conduit; and said frustoconical section collecting said primary and secondary fluids and allowing preliminary mixing of said fluids thereat prior to delivery into said main mixing means.

3. The apparatus as recited in claim 1 wherein said main mixing means comprises:

said impeller element;

said impeller element being rotatable about an axis;

a mixing chamber being cylindrical in shape and substantially surrounding said impeller element; and said impeller being positioned within said chamber with its axis of rotation positioned transverse to the path of flow through said fluid conduit of said outflow.

4. The apparatus as recited in claim 2 wherein said gravity assisted secondary liquid dispensing means comprises:

one or more secondary liquid storage reservoirs situated above said fluid conduit;

one or more passages operably connected between said storage reservoirs and said throat so as to permit downward passage of one or more of said secondary liquids into said first liquid stream within said fluid conduit proximate said throat;

control means interposed between said storage reservoir and said passages for selectively permitting flow of one or more of said secondary liquids from said storage reservoirs to said passages; and said passage and control means allowing simultaneous injection of one or more of said secondary liquids into said flow of first liquid as desired.

5. The apparatus as recited in claim 3 wherein said chamber has an entry and an exit.

said entry being approximately one-half the size of said inlet, and said exit being approximately the same size as said outlet.

6. The apparatus as recited in claim 1 wherein said impeller element includes a plurality of vanes, and said impeller means being rotated by the force of said outflow contacting said vanes.

7. The apparatus as recited in claim 2 wherein said throat has a cross-sectional area substantially smaller than that of said inlet, and said throat tapering to a larger cross-sectional area in the direction of flow of said first liquid stream.

8. The apparatus as recited in claim 2 wherein said throat has first and second tapering segments, said first segment beginning with a first cross-sectional area substantially smaller than that of said inlet, and terminating with a second cross-sectional area larger than said first cross-sectional area, said second segment beginning with a third cross-sectional area the same as said second cross-sectional area, and said second segment tapering to terminate with a cross-sectional area approximating that of said inlet.

* * * * *

UNITED STATES PATENT AND TRADEMARK OFFICE

CERTIFICATE OF CORRECTION

PATENT NO. : 4,432,105

DATED : February 21, 1984

INVENTOR(S) : Pravin G. Pitroda

It is certified that error appears in the above-identified patent and that said Letters Patent is hereby corrected as shown below:

| | |
|---|---|
| Column 7, line 21 | After the word exit delete "." and insert instead -- , --. |

Signed and Sealed this

Tenth Day of July 1984

[SEAL]

*Attest:*

GERALD J. MOSSINGHOFF

*Attesting Officer*

*Commissioner of Patents and Trademarks*